US005712012A

United States Patent [19]

Forman et al.

[11] Patent Number: 5,712,012

[45] Date of Patent: Jan. 27, 1998

[54] ADAPTABLE DISPOSABLE PLACEMAT

[76] Inventors: David S. Forman; Lisa R. Forman, both of 2 Midbridge Dr., Medford, N.J. 08055

[21] Appl. No.: 605,766

[22] Filed: Feb. 22, 1996

Related U.S. Application Data

[63] Continuation-in-part of Ser. No. 318,486, Oct. 5, 1994, abandoned, which is a continuation of Ser. No. 012,509, Feb. 2, 1993, abandoned.

[51] Int. Cl.[6] ..... B32B 29/06; B32B 7/14

[52] U.S. Cl. ..... 428/43; 428/195; 428/211; 428/354; 428/511; 428/537.5; 428/40.1

[58] Field of Search ..... 428/40.1, 43, 343, 428/354, 192, 195, 211, 511, 537.5

[56] References Cited

U.S. PATENT DOCUMENTS

| | | | |
|---|---|---|---|
| D. 243,305 | 2/1977 | Kobashikawa | D6/271 |
| D. 265,038 | 6/1982 | Tomasi | D6/271 |
| D. 272,028 | 1/1984 | Dempster | D6/274 |
| D. 312,548 | 12/1990 | Sewak | D6/614 |
| 3,673,052 | 6/1972 | Small et al. | 156/164 |
| 3,916,051 | 10/1975 | Wakeman | 428/40 |
| 3,920,870 | 11/1975 | Ackerman et al. | 428/46 |
| 3,983,277 | 9/1976 | Ackerman et al. | 428/46 |
| 4,097,297 | 6/1978 | Keene | 106/177 |
| 4,137,356 | 1/1979 | Shoemaker et al. | 428/311.7 X |
| 4,457,964 | 7/1984 | Kaminstein | 428/43 |
| 4,562,926 | 1/1986 | Mode | 206/563 |
| 4,590,109 | 5/1986 | Holmberg | 428/40 |
| 4,614,679 | 9/1986 | Farrington, Jr. et al. | 428/138 |
| 4,617,215 | 10/1986 | Telesco | 428/43 |
| 4,783,354 | 11/1988 | Fagan | 428/40 |
| 4,944,968 | 7/1990 | Wagner | 428/13 |
| 4,961,811 | 10/1990 | Haugwitz | 156/344 |
| 4,995,641 | 2/1991 | Landry et al. | 283/67 |
| 5,102,733 | 4/1992 | Zawadzki | 428/343 |
| 5,328,265 | 7/1994 | Clooney | 383/4 |

*Primary Examiner*—Daniel Zirker
*Attorney, Agent, or Firm*—Duane, Morris & Heckscher LLP

[57] ABSTRACT

Disposable placemats are provided which include a sheet of cellulosic material having top and bottom planar surfaces and a peripheral edge. The placemats include adhesive on their bottom surfaces for affixing them to a dining surface. The placemats can be easily removed from the dining surface following the meal and discarded. They may optionally include a water-resistant coating for preventing soiling and fluid penetration during use. The placemats can be packaged in stacks or rolls for convenience.

9 Claims, 1 Drawing Sheet

ADAPTABLE DISPOSABLE PLACEMAT

CROSS REFERENCE TO RELATED APPLICATIONS

This is a Continuation-In-Part application of U.S. patent application Ser. No. 08/318,486, filed Oct. 5, 1994, which, in turn, is a Continuation application of U.S. patent application Ser. No. 08/012,509, filed Feb. 2,1993, now abandoned, in the names of David S. Forman and Lisa R. Forman, and entitled "Disposable Placemat."

FIELD OF THE INVENTION

This invention relates to placemats, and more particularly, to placemats suitable for use with small children.

BACKGROUND OF THE INVENTION

Placemats are widely available in the prior art for protecting table tops and other eating surfaces during the consumption of meals. Typically, such placemats include a paper sheet printed with some fanciful design or advertisement. In such eating establishments as fast food restaurants and diners, these placemats are laid out on the table for patrons, and thereafter disposed following the meal.

There have been very few improvements to placemat technology over the years, but the art has emphasized such properties as water resistance and non-slipping ability.

Kaminstein, U.S. Pat. No. 4,457,964 discloses a non-slip placemat including a paper web having a blended wax-based coating which coats and impregnates the web to render it hydrophobic and slip-resistant. A series of these webs can be fabricated together and separated with perforated lines for commercial use. Other artisans, as evidenced by Small et al., U.S. Pat. No. 3,673,052, have used patterned cellulosic sheets as placemats.

Although there are commercial placemats having optimum aesthetic characteristics and low cost, they are particularly deficient when used with small children. Children, and especially infants, are known to occasionally flip over placemats during a meal. Whether it is because of frustration, boredom, or just plain curiosity, this antic can create quite a mess, not to mention a loss of efficient service by workers in public eating establishments.

Accordingly, there remains a need in the art for a placemat which is less susceptible to being tampered with by children, but is readily disposable and cost efficient.

SUMMARY OF THE INVENTION

This invention provides disposable placemats, including a sheet of cellulosic material. The placemats have top and bottom planar surfaces and include an adhesive on one of the surfaces for adhering the placemat to a table top or other eating surface. They further include tear facilitating means for providing an arcuate shape to the periphery for enabling them to fit on a baby tray, for example. The adhesive is "releasable", meaning that it can be removed from a surface and reapplied, if necessary, without leaving a significant residue on the surface it is initially attached to. The placemats of this invention also preferably include a hydrophobic or water-resistant coating on the planar surface opposite from the surface containing the adhesive. This coating prevents, or at least minimizes, the tendency for the cellulosic material to be saturated by fluids.

Accordingly, this invention provides a relatively foolproof placemat, which is ideal for small children of about four months to about two years of age. Since the disclosed adhesives can quickly secure the placemat to the table top, it is less likely that a small child will be able to flip over the placemat and disturb the contents of his or her meal. The hydrophobic coatings of this invention also protect the table top from spilled fluids which would normally seep through the cellulosic sheets of the placemats.

In further embodiments of this invention, a roll of placemats is provided in which a series of placemats are arranged consecutively together and separated by a plurality of individual tear lines. These placemats include releasable adhesive on a first planar side of each mat for securing the mat to an eating surface once it has been separated from the roll. A supply of these rolls could be provided to fast food restaurants or airlines to serve the mass market. The rolls can be made compact, so as to fit in a diaper bag or large purse, for portable use.

The placemats of this invention are sanitary, and provide a surface that can substitute for a plate or bowl. It is known that children often are fed from a placemat, since traditional plates and silverware are not always suitable, as in the case of small infants or in situations where fast food is consumed with the aid of hands instead of utensils. The preferred adhesive backing and hydrophobic top surface of the disclosed placemats are ideal for these situations where plates are impractical or unavailable.

The benefits of using an adhesive layer, rather than just a non-slip surface, are that the placemat will be relatively more difficult to upend, and will provide more slip resistance than surfaces that merely provide a higher friction coefficient.

BRIEF DESCRIPTION OF THE DRAWINGS

The accompanying drawings illustrate preferred embodiments of the invention in accordance with the practical application of the principals thereof, and in which.

DETAILED DESCRIPTION OF THE INVENTION

This invention provides placemats which include an adhesive backing for securing them to eating surfaces, such as airline meal trays, dining tables, and similar surfaces. The adhesive backing makes these placemats much more resistant to being flipped over or removed from their initial location on the dining surface.

Figure 1:
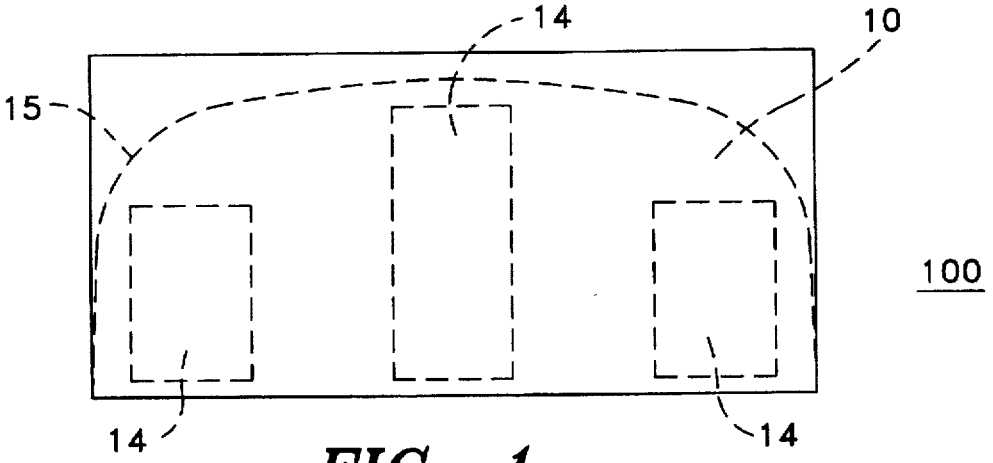
FIG. 1: is a top plan view of a preferred disposable placemat of this invention particularly adapted for a baby tray.
Figure 2:
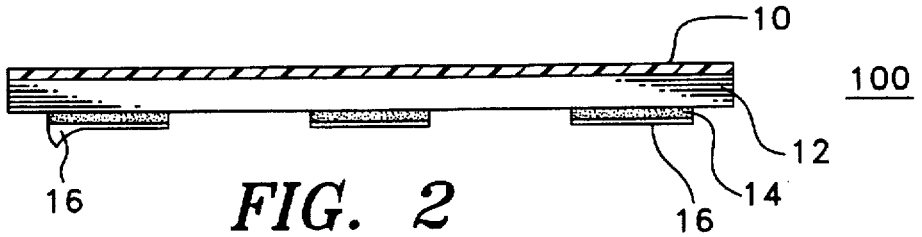
FIG. 2: is a side elevation view of the disposable placemat of FIG. 1, illustrating the partial removal of a preferred release strip.
Figure 3:
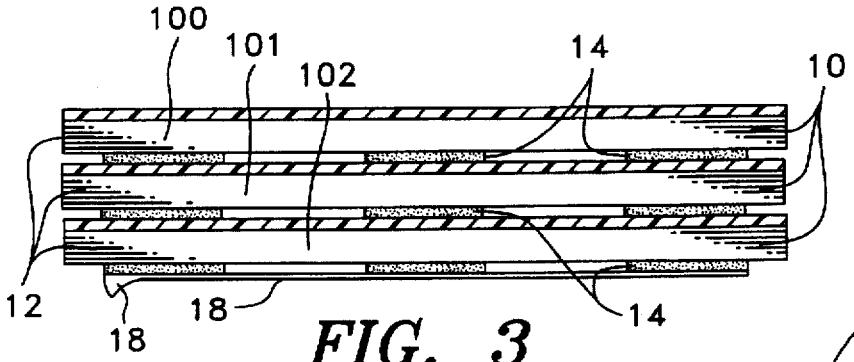
FIG. 3: is a side elevation of an alternative packaging for the preferred disposable placemat of FIG. 1, illustrating a plurality of placemats disposed together by their adhesive strips.
Figure 4:
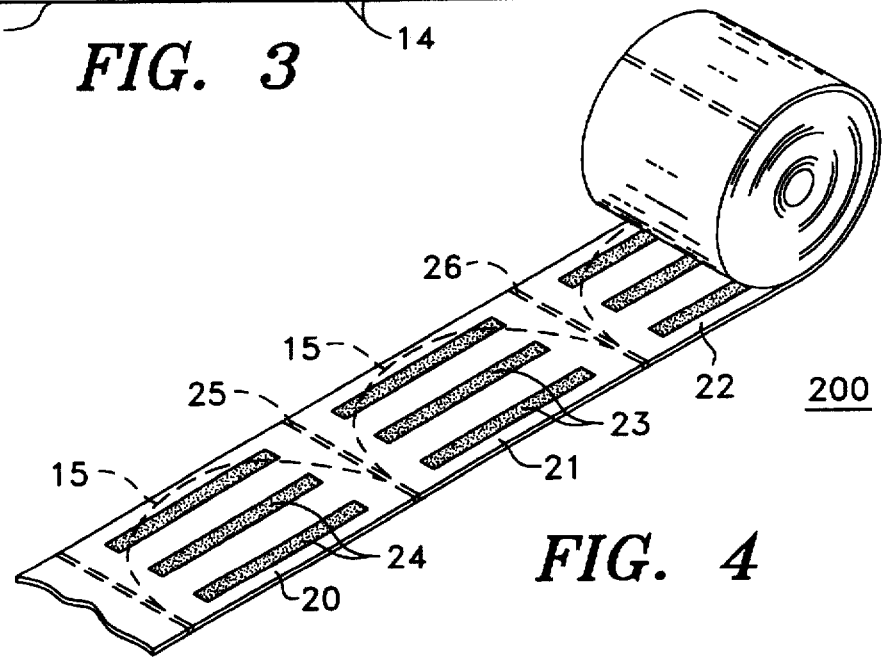
FIG. 4: is a perspective view of a placemat roll of this invention, illustrating a series of consecutive placemats having adhesive lines disposed thereon.

Referring now to FIGS. 1 and 2, there is shown a preferred disposable placemat 100 having a configuration shaped to fit a baby tray. When viewed from above, this configuration includes a beveled top surface and a relatively straight bottom surface, along with a pair of relatively straight side edges which blend with the top and side surfaces. This particular design can be shaped to match the outer periphery of many baby trays, but other shapes can take on any number of configurations, such as rectangles, circles, or squares, depending upon the application as well as the available surface area on the dining surface. In the preferred embodiment, the placemat 100 has a perforated tear line 15 for enabling it to fit nicely on a baby tray. The area of dining surface covered by the placemat should be at least 90 sq. in.

The preferred disposable placemat 100 can include three distinct layers, a cellulosic layer 12, a hydrophobic or water-resistant coating 10, and an adhesive layer 14. Optionally, the entire front and back planar surfaces of the placemat can include a hydrophobic surface, but for the sake of minimizing expense, only the top planar surface is coated in the preferred embodiment.

The adhesive layers 14 attached to the lower planar surface of the placemat 100 are designed to smoothly adhere the placemat to a flat dining surface. These adhesive strips can be a continuous layer substantially co-extensive with the bottom planar surface of the placemat, or a plurality of adhesive strips or patches, such as rectangular adhesive strips. Preferably, the adhesive is protected by release strips 16.

In a second alternative embodiment of this invention, a plurality of disposable placemats 100, 101, and 102 can be stacked together and adhered to one another by their adhesive strips 14 to provide a convenient package for shipping and storage. In this embodiment, the adhesive strips 14 are adhered to the hydrophobic coatings 10 on the top surface of the placemats. In this way, the coating and underlying cellulosic mat 12 can act as a release strip for protecting the adhesive during storage. Since the bottom placemat 102 would not be similarly protected, it is provided with a supplemental release strip 18, or similar backing layer.

In a third preferred embodiment of this invention, a series of consecutive disposable placemats 20, 21, and 22 are disposed in a roll form 200. In this "roll" embodiment, the placemats are provided with adhesive strips 23 and 24 for securing them to a dining surface. The strips also adhere to the underlying placemats in the roll, and consequently, help to keep the roll from unravelling during storage and subsequent use. Of course, the adhesive strips could be provided on the outer-facing or exterior surface, although this could result in fouling or contamination of the adhesive prior to use.

The consecutive placemats 20, 21, and 22 of the roll are preferably separated by individual tear lines 25 and 26 which permit relatively swift separation of an individual placemat from the remainder of the roll. The tear lines 25 and 26 can include individual linear or circular perforations, as is known in the prior art. Additional tear lines 15 can be provided to permit the placemats 20, 21 and 22 to be reconfigured into a shape which can neatly fit within the dining surface of a baby tray.

The preferred materials used in conjunction with the placemats of this invention will now be described. The cellulosic sheets 12 of this invention preferably comprise paper sheets, but optionally may include light-weight polymers, such as polyethylene, polypropylene, or the like. Conventional bleached paper made from wood pulp or recycled newsprint is also highly applicable to this invention.

The hydrophobic coatings of this invention, such as water-resistant coating 10, should be relatively water- and fluid-resistant, so as to protect the underlying cellulosic material from becoming saturated during use. Such hydrophobic coatings can include, for example, emulsions of fluorocarbon polymers, wax, or silicone polymers. Other materials which have been known to induce water resistance to cellulosic materials include rubber cement, asphaltum, cellulose acetate, paint, lacquer, varnish, resin, dry oils and resins, siloxanes and siliconates. Although a discrete coating layer is disclosed in the preferred illustrations, it is understood that the coating may in fact be an impregnated portion of the cellulosic layer 12. Preferred hydrophobic coatings of this invention include wax and silicone impregnated into the cellulosic material during the manufacture of the paper.

The adhesive layers of this invention can be made of any known pressure-sensitive adhesive material. As used herein, the term "pressure-sensitive" refers to any releasable adhesive or releasable tenacious means. Adhesive compositions suitable for placemats include, for example, the water-based, pressure-sensitive adhesives such as acrylate adhesives, e.g., vinyl acetate-2 ethylhexyl acetate copolymer which is generally combined with tackifires, such as ethyleneamine. Alternatively, the adhesive may comprise a rapid setting thermoplastic "hot melt" adhesive or two-side adhesive tape. It is further anticipated that adhesives based on an elastomer selected from natural or synthetic rubbers could be suitable for the purposes of this invention.

In certain embodiments of this invention, such as placemat 100, the adhesive strips 14 are protected by release paper strips 16. The release paper strips 16 may be made of any suitable sheet-like material which adheres with sufficient tenacity to the adhesive members of this invention to remain in place, but can be readily removed when the placemat 100 is to be used. A particularly useful material is a semi-bleached kraft paper, the adhesive contacting side of which has been silicone coated to provide easy removal from the adhesive prior to use.

From the foregoing it can be realized that this invention provides improved disposable placemats, and various means for packaging them for commercial use. The advantages over the prior art are low cost and increased resistance to tampering by small children. Although various embodiments have been illustrated, this was for the purpose of describing, and not limiting the invention. Various modifications, which will become apparent to one skilled in the art, are within the scope of this invention described in the attached claims.

What is claimed is:

1. An adaptable, disposable placemat comprising a sheet of cellulosic material having a top and bottom planar surface and a peripheral edge having at least four sides, said top planar surface comprising a moisture-resistant coating and said bottom planar surface having a pressure sensitive releasable adhesive applied thereto for fixing said placemat to a dining surface, said placemat having tear facilitating means for providing an arcuate shape to at least one of said sides for permitting said placemat to more readily fit on a baby tray.

2. The disposable placemat of claim 1, wherein said cellulosic material comprises paper impregnated with a water-resistant composition.

3. The disposable placemat of claim 1, wherein said tear facilitating means comprises a perforated tear line.

4. The disposable placemat of claim 1, wherein said adhesive comprises at least one pressure-sensitive adhesive strip.

5. The disposable placemat of claim 4, wherein said adhesive strip is protected by a release paper.

6. The disposable placemat of claim 1, wherein said bottom planar surface also comprises a water-resistant coating thereon.

7. The disposable placemat of claim 2 comprising a rectangular peripheral edge and at least a pair of adhesive strips disposed on said bottom planar surface.

8. The disposable placemat of claim 1, wherein said placemat is disposed on a roll.

9. The disposable placemat of claim 1, wherein said placemat is adhered to a baby tray.

* * * * *